US006030071A

United States Patent [19]

Komplin et al.

[11] Patent Number: 6,030,071

[45] Date of Patent: Feb. 29, 2000

[54] PRINTHEAD HAVING HEATING ELEMENT CONDUCTORS ARRANGED IN A MATRIX

[75] Inventors: Steven Robert Komplin; Ashok Murthy; Bradley Leonard Beach, all of Lexington, Ky.

[73] Assignee: Lexmark International, Inc., Lexington, Ky.

[21] Appl. No.: 08/887,822

[22] Filed: Jul. 3, 1997

[51] Int. Cl.[7] ..... B41J 2/05

[52] U.S. Cl. ..... 347/58

[58] Field of Search ..... 347/57, 58, 59, 347/62, 63, 208

[56] References Cited

U.S. PATENT DOCUMENTS

| | | | |
|---|---|---|---|
| 4,458,256 | 7/1984 | Shirato et al. | 347/58 |
| 4,472,723 | 9/1984 | Shibata . | |
| 4,695,853 | 9/1987 | Hackleman et al. | 347/62 |
| 4,777,583 | 10/1988 | Minami et al. . | |
| 4,862,197 | 8/1989 | Stoffel . | |
| 4,870,433 | 9/1989 | Campbell et al. . | |
| 4,899,180 | 2/1990 | Elhatem et al. . | |
| 4,907,015 | 3/1990 | Kaneko et al. . | |
| 4,914,562 | 4/1990 | Abe et al. . | |
| 4,973,986 | 11/1990 | Narita . | |
| 5,091,736 | 2/1992 | Narita . | |
| 5,272,489 | 12/1993 | Kobayashi et al. . | |
| 5,426,451 | 6/1995 | Brock et al. | 347/199 |
| 5,450,109 | 9/1995 | Hock . | |
| 5,512,992 | 4/1996 | Paton . | |
| 5,594,488 | 1/1997 | Tsushima et al. . | |
| 5,731,828 | 3/1998 | Ishinaga et al. | 347/62 |
| 5,815,185 | 9/1998 | Pietrzyk | 347/92 |

*Primary Examiner*—John Barlow
*Assistant Examiner*—Michael S. Brooke
*Attorney, Agent, or Firm*—Jacqueline M. Daspit; Robert M. Showalter

[57] ABSTRACT

A printhead is provided comprising a plate having a plurality of orifices through which ink droplets are ejected and a heater chip coupled to the plate. The heater chip includes a plurality of heating elements and first and second conductors for providing energy to the heating elements. The first and second conductors are arranged in spaced-apart planes and/or in a matrix.

55 Claims, 10 Drawing Sheets

PRINTHEAD HAVING HEATING ELEMENT CONDUCTORS ARRANGED IN A MATRIX

CROSS-REFERENCE TO RELATED APPLICATIONS

This application is related to contemporaneously filed U.S. patent application Ser. No. 08/887,583, entitled "PRINTHEAD HAVING HEATING ELEMENT CONDUCTORS ARRANGED IN SPACED APART PLANES AND INCLUDING HEATING ELEMENTS HAVING A SUBSTANTIALLY CONSTANT CROSS-SECTIONAL AREA IN THE DIRECTION OF CURRENT FLOW," by Murthy et al., and to contemporaneously filed U.S. patent application Ser. No. 08/887,921, entitled "PRINTHEAD HAVING HEATING ELEMENT CONDUCTORS POSITIONED IN SPACED APART PLANES," by Komplin et al., which are both incorporated by reference herein.

FIELD OF THE INVENTION

This invention relates to ink jet printheads having a heater chip provided with heating elements and conductors for delivering energy to the heating elements, wherein the conductors are arranged in spaced-apart planes and/or in a matrix.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and a plate having a plurality of the discharge orifices formed therein. The printhead forms part of an ink jet print cartridge which further comprises an ink-filled container.

The resistors are individually addressed with an energy pulse to momentarily vaporize the ink and form a bubble which expels an ink droplet. A flexible circuit may be used to provide a path for energy pulses to travel from a printer energy supply circuit to the printhead. Bond pads on the printhead are coupled to end sections of traces on the circuit. A plurality of first and second conductors are provided on the heater chip and extend between the bond pads and the resistors. Current is delivered to the resistors via the traces, the bond pads and the first and second conductors.

In first generation printheads, the number of first conductors and associated bond pads equaled the number of resistors provided on the chip. However, fewer second conductors, each coupled to two or more resistors, were provided. The first and second conductors were located in generally the same plane as the resistors.

In order to reduce the number of first conductors and associated bond pads, later printers and printheads were provided with decoder circuitry. Decoder circuitry, however, is expensive and, hence, undesirable.

Accordingly, there is a need for improved structure within an ink jet printhead for providing energy pulses to heating elements.

SUMMARY OF THE INVENTION

This need is met by the present invention wherein an ink jet printhead is provided having a heater chip including a plurality of first and second conductors arranged in spaced-apart planes and/or in a matrix. When conductors are arranged in a matrix, fewer first and second conductors are required on the heater chip. Additionally, decoder circuitry is substantially reduced or completely eliminated. When the first and second conductors are vertically spaced apart, fewer conductors are located in substantially the same plane as the heating elements. Hence, a higher density of heating elements may be provided on the heater chip.

In one embodiment, the heating elements are located on a thermally nonconductive layer. For this reason, it is believed that the heater chip of this embodiment has improved thermal efficiency and, hence, requires less energy to effect bubble formation than conventional heater chips.

DETAILED DESCRIPTION OF THE PREFERRED EMBODIMENT

Figure 1:
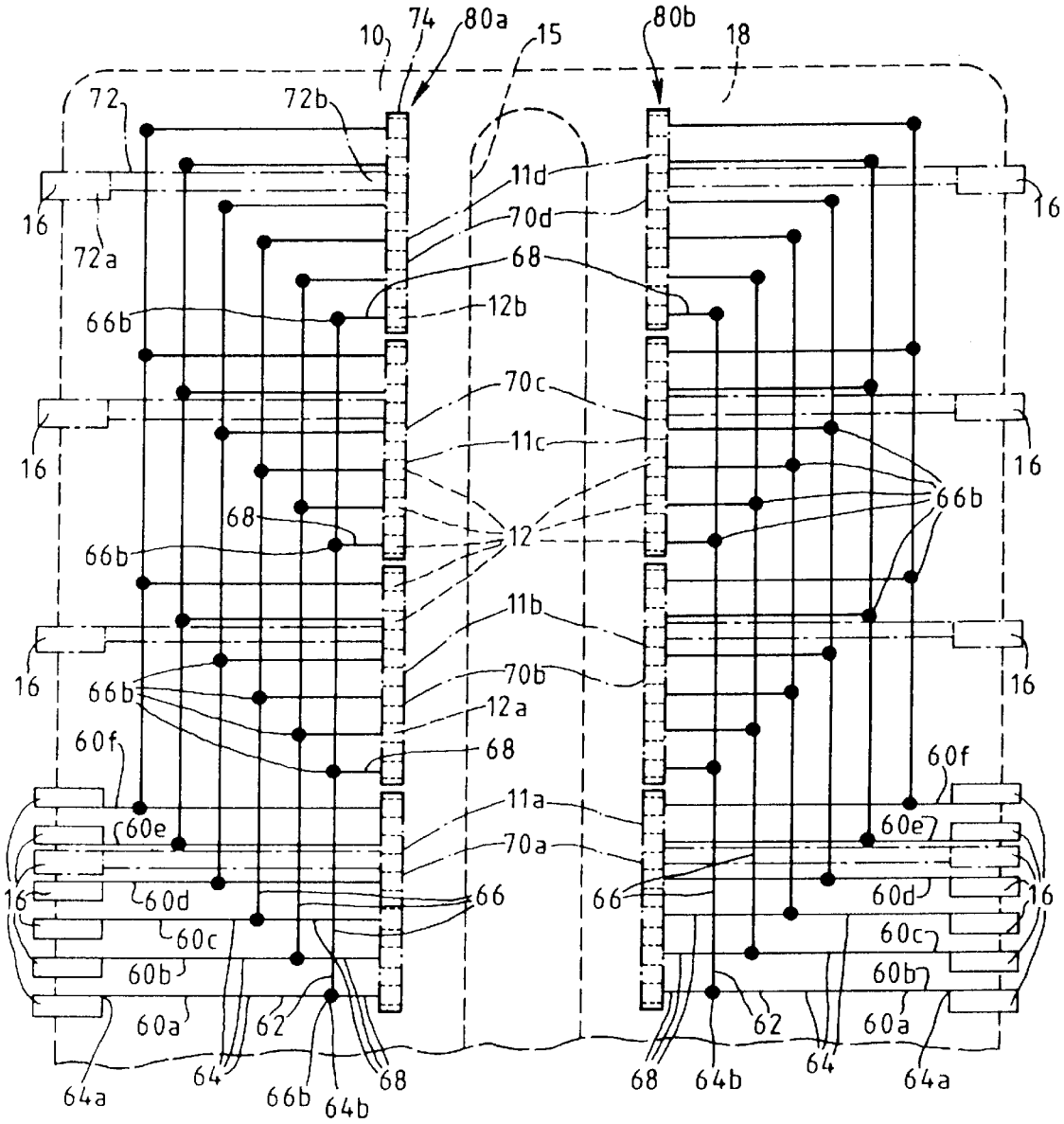
FIG. 1 is a plan view of first and second conductors of a heater chip formed in accordance with a first embodiment of the present invention wherein the first conductors are shown in solid line and the second conductors are shown in dot-dash line.

A heater chip 10, formed in accordance with a first embodiment of the present invention, is illustrated in FIGS.

1–3. An orifice plate 30 is adapted to be secured to the chip 10 via an adhesive 40, see FIG. 3. The coupled chip 10 and plate 30 define an ink jet printhead which is secured to an ink-filled often polymeric container 2. The joined polymeric container and printhead form a portion of an ink jet print cartridge 1 which is adapted to be installed in an ink jet printer (not shown). The polymeric container 2 may be capable of being refilled with ink.

In the illustrated embodiment, the heater chip 10 is provided with a plurality of T-shaped resistive heating element sections 11*a*–11*d*. As will be discussed more explicitly below, portions of the heating element sections 11*a*–11*d* define resistive heating elements 12. While the heating elements 12 in the embodiment illustrated in FIGS. 1–3 comprise portions of the heating element sections 11*a*–11*d*, the heating elements 12 are designated in FIGS. 1 and 2 by squares shown in dotted line to allow for ease in understanding the present invention.

The plate 30 includes openings 32 which extend completely through the plate 30 and define orifices 32*a* through which ink droplets are ejected. Sections 34 of the plate 30 and portions 14 of the heater chip 10 define a plurality of ink containing chambers, also known as bubble chambers 50. The resistive heating element sections 11*a*–11*d* are located on the chip 10 such that a portion of a heating element section 11*a*–11*d*, i.e., a single heating element 12, is associated with each of the bubble chambers 50, see FIG. 3. Ink supplied by the polymeric container flows into a central opening 15 formed in the chip 10. The ink then moves through ink supply channels 52 into the bubble chambers 50.

The resistive heating elements 12 are individually addressed by energy pulses. Each energy pulse is applied to a heating element 12 to momentarily vaporize the ink in the bubble chamber 50 with which the heating element 12 is associated to form a bubble within the chamber 50. The function of the bubble is to displace ink within the chamber 50 such that a droplet of ink is expelled through the bubble chamber orifice 32*a*.

A flexible circuit (not shown) secured to the polymeric container is used to provide a path for energy pulses to travel from a printer energy supply circuit to the heater chip 10. Bond pads 16, see FIG. 1, on the heater chip 10 are bonded to end sections of traces (not shown) on the flexible circuit. Current flows from the printer energy supply circuit to the traces on the flexible circuit and from the traces to the bond pads 16 on the heater chip 10.

The heater chip 10 comprises a main body portion 18 including a plurality of first and second conductors. In FIG. 1, first and second sets 80*a* and 80*b* of six first conductors 60*a*–60*f*, four second conductors 70*a*–70*d*, and four heating element sections 11*a*–11*d* are shown on opposite sides of the central opening 15. Each heating element section 11*a*–11*d* defines six subsections forming heating elements 12 such that four heating element sections 11*a*–11*d* provide 24 heating elements 12. Thus, the eight heating element sections 11*a*–11*d* provide 48 heating elements 12. The first and second conductors 60*a*–60*f* and 70*a*–70*d* in each of the first and second sets 80*a* and 80*b* are arranged in a matrix having first conductor rows and second conductor columns. Each second conductor column is defined by a single second conductor 70*a*–70*d* such that four columns are provided which are positioned in-line with one another. Hence, only six first conductors 60*a*–60*f* and four second conductors 70*a*–70*d* are required to effect the firing of 24 heating elements 12. It is contemplated by the present invention that the number of heating elements 12 and the number of first and second conductors 60 and 70 provided on the chip 10 may be varied.

In the illustrated embodiment, each of the first conductors 60*a*–60*f* comprises one primary conductor 62 and four secondary conductors 68. The primary conductor 62 has first and second segments 64 and 66. The first end 64*a* of the first segment 64 is coupled to a bond pad 16. The second end 64*b* of the first segment 64 is coupled to a second segment 66. The second segment 66 is coupled to four secondary conductors 68 at spaced-apart points 66*b* along its length. Each of the four secondary conductors 68 to which a given second segment 66 is coupled extends below and is positioned inline with a different one of the four second conductors 70*a*–70*d*, see FIGS. 1–3. Thus, each of the four second conductors 70*a*–70*d* is positioned above and is located in-line with a single secondary conductor 68 of each of the first conductors 60*a*–60*f*.

Each of the second conductors 70*a*–70*d* comprises a first segment 72 and a second segment 74 which is substantially transverse to the first segment 72. A first end 72*a* of the first segment 72 is coupled to a bond pad 16 while a second end 72*b* of the first segment 72 is coupled to the second segment 74 at an intermediate point along the second segment 74. Each second segment 74 extends over and contacts six heating elements 12.

In order to effect the firing of a given heating element 12, current is passed through the first conductor 60*a*–60*f* which is positioned directly below the heating element 12 and the second conductor 70*a*–70*d* which is positioned above and contacts the heating element 12. For example, heating element 12*a* in FIG. 1 is fired by passing current through the first conductor 60*b* and the second conductor 70*b*. Heating element 12*b* is fired by passing current through the first conductor 60*a* and the second conductor 70*d*.

Figure 2:
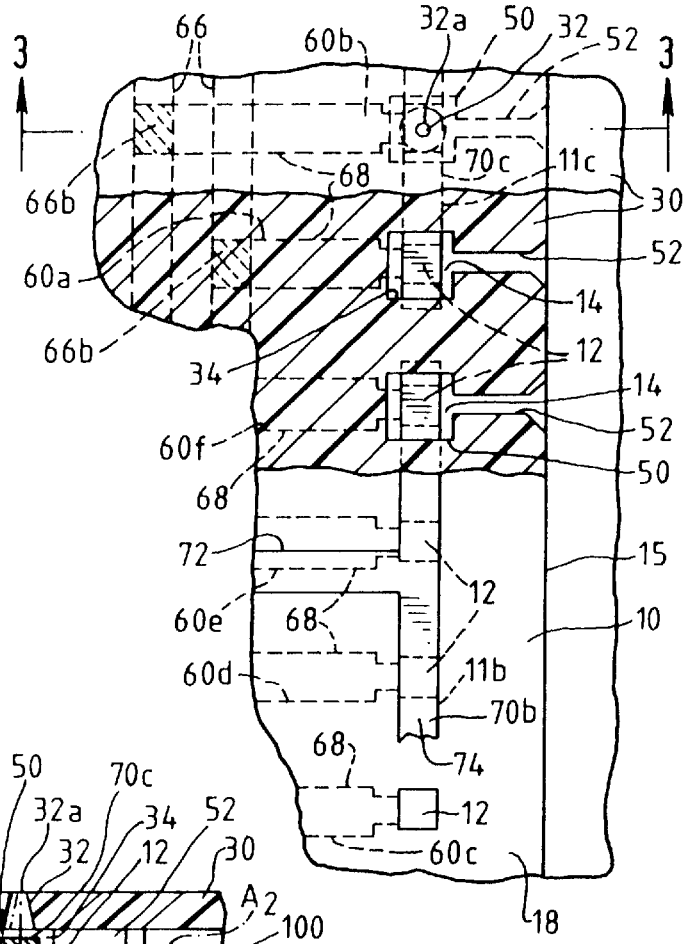
FIG. 2 is a plan view of a portion of a heater chip coupled to an orifice plate with sections of the orifice plate removed at two different levels.
Figure 3:
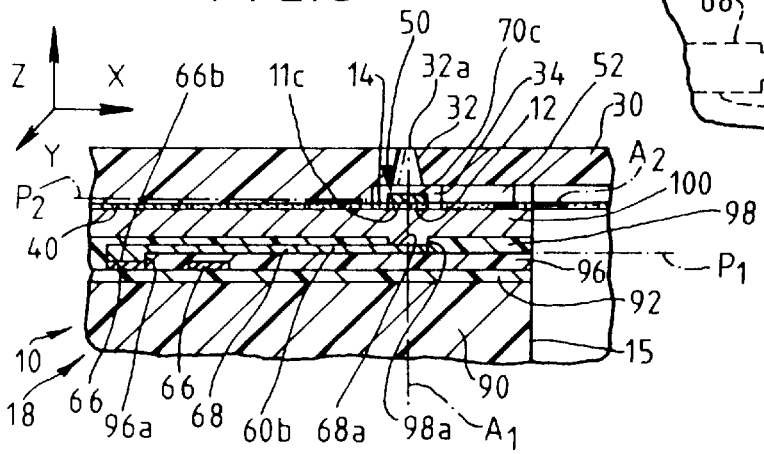
FIG. 3 is a view taken along section line 3—3 in FIG. 2.

In the embodiment illustrated in FIGS. 1–3, the main body portion 18 further includes a base portion 90 and a first dielectric layer 92 formed over the base portion 90. The base portion 90 may be formed from silicon, i.e., it may comprise a silicon wafer section. Alternatively, the base portion 90 may be formed from any other substrate material which is substantially ink resistant, such as alumina or stainless steel. The dielectric layer 92 may be formed from any commercially available dielectric material, such as silicon dioxide or silicon nitride. The base portion 90 preferably has a thickness of from about 400 $\mu$m to about 800 $\mu$m, as measured in the Z-direction, see FIG. 3. The dielectric layer 92 preferably has a thickness of from about 0.1 $\mu$m to about 5.0 $\mu$m. If the dielectric layer 92 is formed from silicon dioxide, it may be formed via a conventional thermal oxidation, sputtering or chemical vapor deposition process. If the dielectric layer 92 is formed from silicon nitride, it may be formed via a sputtering or chemical vapor deposition process.

The primary conductors 62, including both the first and second segments 64 and 66, are formed on the dielectric layer 92. Aluminum or any other highly conductive material, such as copper or gold, may be employed. For example, a layer of aluminum may be added to the dielectric layer 92 via a conventional vacuum evaporation process. Alternatively, a conventional sputter deposition process may be employed. A conventional photomasking process is then used to remove unwanted metal such that the remaining metal defines the primary conductors 62. It is also contemplated that a conventional lift-off photolithography process may be used to remove the unwanted metal. The lift-off process involves forming a photoresist layer (also referred to herein as a resist layer) on the dielectric layer 92 before adding the aluminum material. During a development step, resist material located in areas where the conductors 62 are to be formed is removed. The aluminum layer is then deposited. Thereafter, remaining resist material and aluminum formed over the remaining resist material are removed. The aluminum not removed defines the primary conductors 62. The conductors 62 preferably have a thickness of from about 0.2 μm to about 2 μm, as measured in the Z-direction, see FIG. 3. The first segments 64 preferably have a width of from about 10 μm to about 100 μm, as measured in the Y-direction, and the second segments 66 preferably have a width of from about 10 μm to about 100 μm, as measured in the X-direction.

A second dielectric layer 96 is formed over the exposed portions of the dielectric layer 92 and the conductors 62. The layer 96 is preferably formed from any one of a number of commercially available polymeric photoresist materials. An example of such a material is a negative acting photoresist material, which is commercially available from Shipley Company Inc. under the product name "MEGAPOSIT SNR™ 248 PHOTO RESIST." The dielectric layer 96 extends into areas between the conductors 62 so as to prevent current movement between adjacent conductors 62. The layer 96 also covers the conductors 62 except at the points 66*b* where the second segments 66 of the conductors 62 are to be coupled to the secondary conductors 68, see FIG. 3. A conventional material removal process, a development process in the illustrated embodiment, is used to remove portions of the dielectric layer 96 located above the points 66*b* so as to form openings 96*a* in the layer 96. The dielectric layer 96, at locations not covering the conductors 62, preferably has a thickness of from about 1 μm to about 5 μm, as measured in the Z-direction, see FIG. 3.

The secondary conductors 68 are added to the dielectric layer 96 such that they are positioned in a first horizontal plane $P_1$, see FIG. 3. The conductors 68 are preferably formed from aluminum or a like material via a conventional vacuum evaporation process and a photomasking process. Alternatively, the conductors 68 may be formed via a conventional sputter deposition process and/or a lift-off photolithography process. The aluminum material extends through the openings 96*a* in the dielectric layer 96. Hence, the secondary conductors 68 extend through the openings 96*a* in the layer 96 and engage the second segments 66 of the conductors 62 at points 66*b*. The conductors 68 preferably have a thickness of from about 0.2 μm to about 2 μm, as measured in the Z-direction, and a width of from about 10 μm to about 100 μm, as measured in the Y-direction, see FIG. 3.

A third dielectric layer 98 is added over the exposed portions of the dielectric layer 96 and the conductors 68. The layer 98 preferably comprises the same material from which the dielectric layer 96 is formed. The layer 98 extends into areas between the conductors 68 so as to prevent current movement between adjacent conductors 68. The layer 98 also extends over the conductors 68. However, a conventional material removal process, a development process in the illustrated embodiment, is used to form openings 98*a* in the dielectric layer 98 located above end regions 68*a* of the conductors 68, which regions 68*a* are positioned in-line with the heating elements 12, see FIG. 3. The openings 98*a* may be square in shape having a length along each side which is from about 15 microns to about 50 microns and preferably about 30 microns. The openings to 98*a* may also be circular, elliptical, annular or rectangular in shape. If the openings 98*a* are square or rectangular, they may have rounded corners. The dielectric layer 98, at regions not positioned over a conductor 68, preferably has a thickness of from about 1 μm to about 5 μm, as measured in the Z-direction, see FIG. 3.

In the FIG. 3 embodiment, a current transfer layer 100 is added to the dielectric layer 98. It extends through the openings 98*a* in the dielectric layer 98 so as to engage the end regions 68*a* of the conductors 68. Preferably, the material from which the layer 100 is formed is electrically conductive so as to allow current to flow between the first conductors 60*a*–60*f* and the heating elements 12. The material, however, should not be so conductive as to allow current to flow substantially into a neighboring heating element 12. The resistivity of the material is preferably from about 0.1 Ω-cm to about 5 Ω-cm, and more preferably about 1 Ω-cm. It is also preferred that the material be temperature resistant if heated to a temperature of less than about 350° C. for about 5 μseconds. It is further preferred that the material be thermally non-conductive. The thermal conductivity of the material is preferably from about 0.1 W/m° C. to about 15 W/m° C., and more preferably from about 0.1 W/m° C. to about 0.5 W/m° C. Most preferably, the material is a high temperature resistant polymer loaded with an electrically conductive filler. An example of such a material is a carbon-filled polyimide material. Such a material may be formed by blending a commercially available polyimide material with a carbon black material such that the latter is generally evenly dispersed throughout the polyimide material. The current transfer layer 100 may be formed via a conventional spin application process followed by a conventional oven curing process. The layer 100 preferably has a thickness of from about 5 μm to about 50 μm, as measured in the Z-direction, see FIG. 3.

The heating element sections 11*a*–11*d* are formed on the current transfer layer 100, see FIG. 3. The resistive material from which the heating element sections 11*a*–11*d* are formed preferably comprises $TaO_x$. X is <2 and preferably <<1, thus indicating a substantially non-stoichiometric condition. This material may be deposited via a reactive sputtering process. During that process, oxygen gas along with an inert working gas is added to a vacuum chamber. The oxygen gas reacts with the tantalum vapor material in the chamber so as to deposit as $TaO_x$. The pressure of the oxygen gas in the chamber is varied so as to vary the stoichiometry of the material. Other materials such as aluminum oxide may be used to form the heating element sections 11*a*–11*d*. Preferably, the heating element sections 11*a*–11*d* have a resistivity which is from about 10 Ω-cm to about 400 Ω-cm, and preferably is about 40 Ω-cm for a thickness of about 1000 angstroms, when measured in the Z-direction, see FIG. 3. The thickness of the heating element sections 11*a*–11*d* is preferably from about 800 angstroms to about 10,000 angstroms.

In the illustrated embodiment, the heating element sections 11*a*–11*d* comprise four discrete T-shaped sections 11*a*–11*d*. A photomasking or a lift-off photolithography process may be used to remove unwanted resistive material so as to form the four heating element sections 11*a*–11*d*. In another embodiment, the resistive material removal step is not performed such that a blanket of resistive material remains on the current transfer layer 100. In this and the FIG. 1 embodiments, the heating elements 12 comprise resistive material layer portions which are located between intersecting sections of the first and second conductors 60*a*–60*f* and 70*a*–70*d*. More specifically, the heating elements 12 comprise the heated zones of the heating element sections 11*a*–11*d* when current passes through the sections 11*a*–11*d*. The size of the heated zones is defined generally by the size of the openings 98*a*. Thus, for square openings 98*a* having 30 micron sides, the surface area of each of the heating elements 12 is about $9\times10^{-10}$ $m^2$. As noted above, the resistive material layer portions which comprise the heating elements 12 are designated by squares shown in dotted line in FIGS. 1 and 2.

The heating elements 12, i.e., the resistive material layer portions between intersecting sections of the first and second conductors 60*a*–60*f* and 70*a*–70*d*, preferably have a substantially constant cross-sectional area along a first axis $A_1$ which is generally parallel to the direction of current flow between the first and second conductors 60*a*–60*f* and 70*a*–70*d*, see FIG. 3. Because the cross-sectional area of each heating element 12 in the direction of current flow does not vary, it is believed that generally uniform heating of each heating element 12 will occur. This is in contrast to a heating element having a non-uniform cross-section area in the direction of current flow. In such a heating element, it is believed that "hot" and "cold" zones may result when current passes through it. "Cold" zones reduce the overall efficiency of the heating element and may adversely affect print quality.

Because current flow in the present invention occurs along a generally vertical axis which passes through the heating element upper surface, i.e., the surface closest to the ink-containing chamber 50, each heating element 12 may have a substantially nonuniform cross-sectional area along a second axis $A_2$ which is generally orthogonal to the first axis $A_1$. Thus, the heated zones, i.e., the heating elements 12, of the heating element sections 11*a*–11*d* may be cylindrical in shape such that they have a circular ink-facing surface. The heated zones may also comprise hollow cylinders such that they have an annular ink-facing surface. The shape of the heated zones is determined by the shape of the openings 98*a*. If the openings 98*a* are circular, the heated zones will be cylindrical in shape. If the openings 98*a* are annular, the heated zones will have the shape of a hollow cylinder. Thus, the ink-facing surface of the heated zones or heating elements 12 may have a rounded or curvilinear section, e.g., they may be circular or annular in shape. They may also be square or rectangular in shape and have rounded corners. Consequently, the heating elements may be more readily configured so as to minimize damage to the heating elements due to concentrated shock waves produced during contraction of air bubbles in the ink. This added benefit may occur without sacrificing heating element efficiency as the cross-sectional area of each heating element 12 remains substantially constant in the direction of current flow.

The second conductors 70*a*–70*d* are formed over the heating element sections 11*a*–11*d*. So as to prevent current from bypassing the heating elements 12 and flowing directly between the current transfer layer 100 and one of the second conductors 70*a*–70*d*, the second conductors 70*a*–70*d* do not contact the current transfer layer 100 in areas close to the openings 98*a* in the dielectric layer 98. In the illustrated embodiment, the second conductors 70*a*–70*d* are coextensive with the heating element sections 11*a*–11*d* and, hence, do not contact the current transfer layer 100. The second conductors 70*a*–70*d* are positioned in a second horizontal plane $P_2$ which is vertically spaced from the first horizontal plane $P_1$, see FIG. 3. The second conductors 70*a*–70*d* may be created, for example, from tantalum using a conventional sputter deposition process followed by conventional photomasking and etch back processes. Alternatively, a conventional vacuum evaporation process and a lift-off photolithography process may be used. Metals which are substantially non-reactive with ink, such as gold, may be used instead of tantalum. Other metals may also be used such as aluminum, copper and alloys prepared therefrom provided there is a passivation (protective) layer provided over the second conductors 70*a*–70*d*.

The tantalum layer may be applied in the same sputtering run during which the heating element sections 11*a*–11*d* are formed. This is accomplished by adding only an inert working gas into the vacuum chamber after the layer of $TaO_x$ has been formed. If the lift-off process is employed, a stripping solution is used to remove the photoresist material. The unwanted $TaO_x$ and tantalum material are removed with the photoresist material. The remaining $TaO_x$ resistive material defines the heating element sections 11*a*–11*d*, which have substantially the same T-shape as the second conductors 70*a*–70*d*. Thus, the heating elements 12 comprise portions of the T-shaped sections 11*a*–11*d* positioned between intersecting sections of the first and second conductors 60*a*–60*f* and 70*a*–70*d*. The second conductors 70*a*–70*d* preferably have a thickness of from about 0.2 $\mu$m to about 2 $\mu$m when measured in the Z-direction, and a width of from about 10 $\mu$m to about 100 $\mu$m as measured in the X-direction.

After the second conductors 70*a*–70*d* have been formed, the orifice plate 30 is secured to the current transfer layer 100 and the second conductors 70*a*–70*d* via an adhesive 40. An example of such an orifice plate 30 and example adhesives are set out in commonly owned patent application, U.S. Ser. No. 08/519,906, entitled "METHOD OF FORMING AN INKJET PRINTHEAD NOZZLE STRUCTURE," by Tonya H. Jackson et al., filed on Aug. 28, 1995, Attorney Docket No. LE9-95-024, the disclosure of which is hereby incorporated by reference. As noted therein, the plate 30 may be formed from a polymeric material such as polyimide, polyester, fluorocarbon polymer, or polycarbonate, which is preferably about 15 to about 200 microns thick, and most preferably about 75 to about 125 microns thick. The adhesive may comprise any B-stageable thermal cure resin including phenolic resins, resorcinol resins, urea resins, epoxy resins, ethylene-urea resins, furane resins, polyurethanes, and silicone resins. Other suitable adhesive materials include macromolecular thermoplastic, or hot melt, materials such as ethylene-vinyl acetate, ethylene ethylacrylate, polypropylene, polystryrene, polyamides, polyesters and polyurethanes.

As noted above, in order to effect the firing of a given heating element 12, current is passed through the first conductor 60*a*–60*f* which is positioned directly below that heating element 12 and the second conductor 70*a*–70*d* which engages the element 12. The current transfer layer 100, which is positioned between the first conductor and the heating element 12, provides a path for current to flow in the Z-direction between the first conductor and the heating element 12. If the first conductor is positive, current passes in the Z-direction from the first conductor through the current transfer layer 100 and the heating element 12 to the second conductor. If the second conductor is positive, the current flows in the Z-direction from the second conductor through the heating element 12 and the current transfer layer 100 to the first conductor.

A heater chip 110 formed in accordance with a second embodiment of the present invention is illustrated in FIGS. 4–8, wherein like reference numerals indicate like elements. The chip 110 comprises a main body portion 118 including a plurality of first and second conductors 160 and 170. The first and second conductors 160 and 170 are arranged in a matrix, see FIG. 4.

Figure 4:
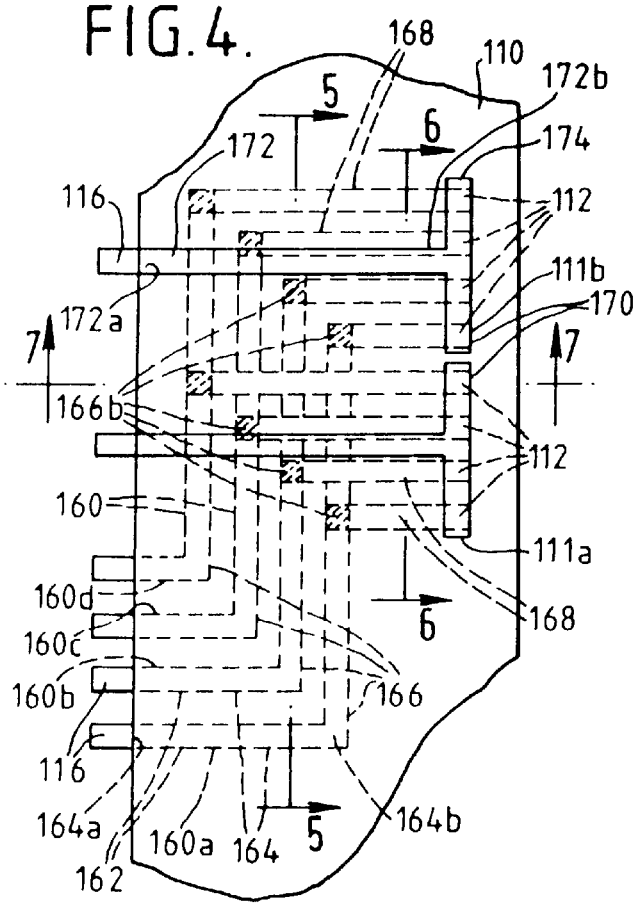
FIG. 4 is a plan view of a portion of a heater chip formed in accordance with a second embodiment of the present invention.
Figure 5:
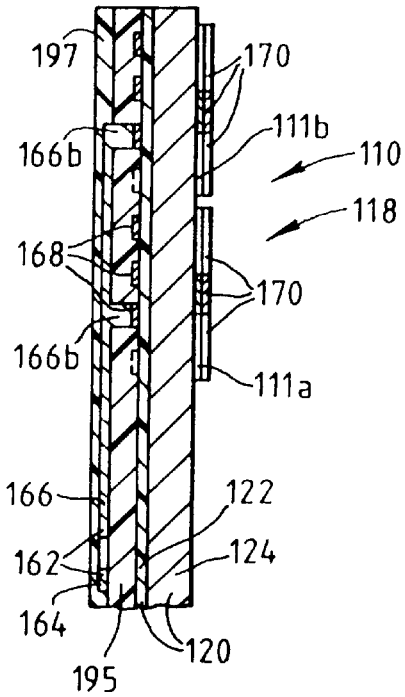
FIG. 5 is a view taken along view line 5—5 in FIG. 4.
Figure 6:
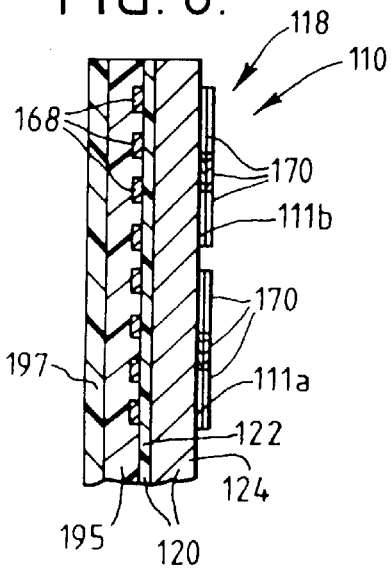
FIG. 6 is a view taken along view line 6—6 in FIG. 4.

In the FIG. 4 embodiment, two T-shaped heating element sections 111*a* and 111*b* are provided on the chip 110.

Portions of the heating element sections 111*a* and 111*b* define subsections forming resistive heating elements 112. For ease in understanding, the heating elements 112 are designated by dotted line squares in FIG. 4.

Four first conductors 160*a*–160*d* are illustrated in FIG. 4. Each of the first conductors 160*a*–160*d* comprises one primary conductor 162 and a plurality of secondary conductors 168, two in the embodiment illustrated in FIG. 4. Each primary conductor 162 has first and second segments 164 and 166. The first end 164*a* of the first segment 164 is coupled to a bond pad 116. The second end 164*b* of the first segment 164 is coupled to a second segment 166. The second segment 166 is coupled to its two secondary conductors 168 at spaced-apart points 166*b* along its length, see FIG. 5. Each of the two secondary conductors 168 to which a given second segment 166 is coupled extends below and is positioned in-line with a different one of the two second conductors 170, see FIGS. 4 and 5. Thus, each of the two second conductors 170 is positioned above and is located in-line with a single secondary conductor 168 of each of the first conductors 160*a*–160*d*.

Each of the second conductors 170 comprises a first segment 172 and a second segment 174 which is substantially transverse to the first segment 172. A first end 172*a* of the first segment 172 is coupled to a bond pad 116 while a second end 172*b* of the first segment 172 is coupled to the second segment 174 at an intermediate point along the second segment 174.

In order to effect the firing of a given heating element 112, current is passed through the first conductor 160 which is positioned directly below that heating element 112 and the second conductor 170 which engages the element 112.

In this embodiment, the chip is not constructed on a silicon wafer or like substrate material. Rather, the chip is formed by initially providing a substrate 120 comprising integral dielectric and current transfer layers 122 and 124. The dielectric layer 122, also referred to herein as a first dielectric layer, preferably comprises a polymeric material such as a polyimide material. The current transfer layer 124 preferably comprises a high temperature resistant polymer loaded with an electrically conductive filler, such as a carbon-filled polyimide material. The current transfer layer 124 preferably has a resistivity which is from about 0.1 Ω-cm to about 5 Ω-cm, and more preferably about 1 Ω-cm. The thermal conductivity of the current transfer layer 124 is preferably from about 0.1 W/m° C. to about 3.0 W/m° C., and more preferably about 0.37 W/m° C. The dielectric layer 122 preferably has a thickness of from about 1 μm to about 100 μm, more preferably from about 1 μm to about 20 μm and most preferably from about 1 μm to about 5 μm. The current transfer layer 124 preferably has a thickness of from about 1 μm about 100 μm, more preferably from about 1 μm to about 20 μm and most preferably from about 1 μm to about 5 μm. An example of such a substrate is one which is commercially available from DuPont Films under the product designation "KAPTON® XC."

Portions of the dielectric layer 122 positioned directly below locations where the heating elements 112 are to be positioned on the current transfer layer 124 are removed via a conventional laser ablation process, see opening 122*a* in FIG. 7. Laser ablation is accomplished at an energy density level of about 100 millijoules/centimeter$^2$ to about 5,000 millijoules/centimeter$^2$, and preferably about 1,000 millijoules/centimeter$^2$. During the laser ablation process, a laser beam with a wavelength of from about 150 nanometers to about 400 nanometers, and most preferably about 248 nanometers, is applied in pulses lasting from about one nanosecond to about 200 nanoseconds, and most preferably about 20 nanoseconds. The openings 122*a* are not limited to any particular shape and may be square, rectangular, circular or annular in shape.

Figure 7:
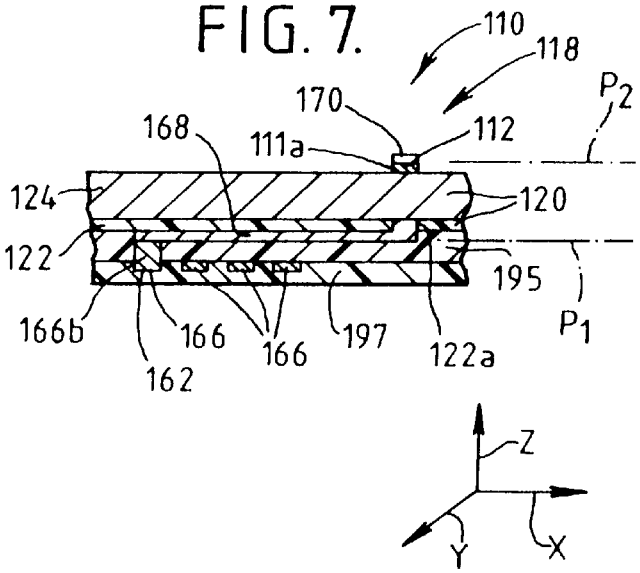
FIG. 7 is a view taken along view line 7—7 in FIG. 4.

The secondary conductors 168 are added to the first dielectric layer 122 and extend along a first horizontal plane $P_1$, see FIG. 7. The conductors 168 are preferably formed from aluminum or a like material via conventional vacuum evaporation and photomasking processes. Alternatively, a sputter deposition process and/or a lift-off photolithography process may be used. The aluminum material extends through the openings 122*a* in the dielectric layer 122, see FIG. 7. Hence, the secondary conductors 168 engage the current transfer layer 124. The conductors 168 preferably have a thickness of from about 0.2 μm to about 2 μm, as measured in the Z-direction, and a width of from about 40 μm to about 400 μm, as measured in the Y-direction, see FIG. 7.

A second dielectric layer 195 is added over the exposed portions of the dielectric layer 122 and the conductors 168. The layer 195 preferably comprises the same material from which the dielectric layer 96, discussed above, is formed. The layer 195 extends into areas between the conductors 168 so as to prevent current movement between adjacent conductors 168. The layer 195 also extends over the conductors 168. However, a conventional material removal process, a development process in the illustrated embodiment, is used to remove portions of the dielectric layer 195 positioned directly above locations where the second segments 166 are to be coupled to the conductors 168, i.e., over points 166*b* on the second segments 166. The dielectric layer 195, at regions not positioned over a conductor 168, preferably has a thickness of from about 1 μm to about 5 μm, as measured in the Z-direction, see FIG. 7.

The primary conductors 162, including the first and second segments 164 and 166, are formed on the dielectric layer 195. Aluminum or any other highly conductive material, such as copper or gold, may be employed. For example, a layer of aluminum may be added to the dielectric layer 195 via a conventional vacuum evaporation process. Alternatively, a conventional sputter deposition process or other similar process may be employed. A conventional photomasking process is then used to remove unwanted metal such that the remaining metal defines the primary conductors 162. It is also contemplated that a conventional lift-off photolithography process may be used to remove the unwanted metal. The conductors 162 preferably have a thickness of from about 0.2 μm to about 2 μm, and a width of from about 10 μm to about 100 μm.

A protective layer 197 is added over the exposed portions of the dielectric layer 122 and the conductors 168. Preferably, this layer 197 is formed from solder mask via a conventional spray or roll lamination process. The layer 197 preferably has a thickness, as measured in the Z-direction, of from about 10 μm to about 100 μm.

The heating element sections 111*a* and 111*b* are formed on the current transfer layer 124. Preferably, the heating element sections 111*a* and 111*b* are formed from substantially the same material and in substantially the same manner as the heating element sections 11*a*–11*d* of the embodiment illustrated in FIGS. 1–3. The second conductors 170 are formed over the heating element sections 111*a* and 111*b*. The second conductors 170 are preferably formed from substantially the same materials and in substantially the same way as the second conductors 70*a*–70*d* of the embodiment illustrated in FIGS. 1–3.

Figure 8:
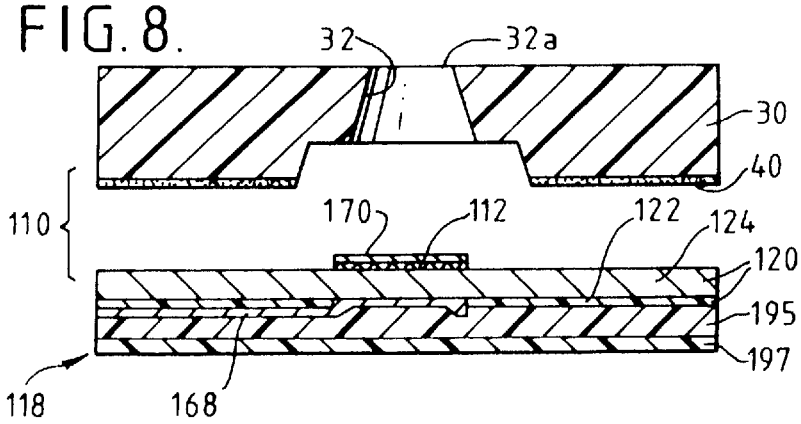
FIG. 8 is an exploded, cross-sectional view taken through a chip formed in accordance with the second embodiment of the present invention.

After the second conductors 170 have been formed, the orifice plate 30 is secured to the current transfer layer 124 and the second conductors 170 via an adhesive 40, see FIG. 8.

Because the cur-rent transfer layer 100 or 124 is thermally non-conductive, it is believed that less energy in the form of heat is dissipated by the heating elements into the underlying current transfer layer 100 or 124 than in prior art devices where the heating elements are typically formed on a thermally conductive material, such as silicon. For this reason, it is further believed that the amount of energy required to effect bubble formation is reduced in the printhead of the first and second embodiments of the present invention when compared with energy amounts required to effect bubble formation in conventional printheads.

It is believed that heater chips constructed in accordance with the first and second embodiments of the present invention having heating elements 12 with a resistance of from about 300 Ω to about 600 Ω require a current pulse having an amplitude of from about 5 to about 30 milliamps and a pulse width of from about 1 μs to 5 μs and preferably about 2 μs to cause a droplet of ink to be expelled through a bubble chamber orifice.

In a test device having a single heating element, bubble formation was achieved when the heating element, which had a resistance of about 400 Ω, received a current pulse having a pulse width of about 2 μs and an amplitude of from about 7.5 mA to about 20 mA. Voltage was from about 3 V to about 8 V and power/pulse was less than about 0.32 μj/pulse. The heating element or heated zone was substantially circular in shape and had a diameter of about 20 μm to about 30 μm. The thickness of the heating element was about 1000 μm. In contrast, about 6–7 μj/pulse is required to effect bubble formation with a conventional heater chip. Thus, this test device provided approximately a 10 times reduction in the amount of power needed to achieve bubble formation.

The following example is being provided for illustrative purposes only and is not intended to be limiting.

EXAMPLE 1

A computer simulation of a printhead including a heater chip in accordance with the second embodiment of the present invention was used. The simulated chip included an aluminum oxide heating element continuous layer having a thickness in the Z-direction of about 0.1 μm, a resistivity of about 2 Ω-m, a density of about 3800 Kg/m$^3$, a thermal conductivity of 30 W/m° C., and a specific heat of about 1580 J/Kg° C. The current transfer layer 124 had a thickness in the Z-direction of about 20 μm, a resistivity of about 0.006 Ω-m, a density of about 1200 Kg/m$^3$, a thermal conductivity of 0.37 W/m° C., and a specific heat of about 1305 J/Kg ° C. The width of the positive and negative conductors 160 and 170 was about 20 μm. A 1 μsecond voltage pulse having an amplitude of about 15 V was applied to the heating elements. The calculated temperature at the surfaces of the heating elements was approximately 546° C. Approximately 25 milliamps of current was applied to the heating elements. Typically, about 250 milliamps of current is required to fire a heating element in a conventional printhead. Hence, much less energy was required to effect the firing of a heating element in this simulated printhead.

It is further contemplated that a chip formed in accordance with the present invention may include a plurality of heating element sections, each of which defines only a single heating element. Each heating element section is preferably sized larger than its corresponding opening 98*a* or 122*a* in the dielectric layer 98 or 122. The shape and size of the heating elements or the heated zones will be determined by the shape and size of the openings 98*a* and 122*a*. The openings 98*a* and 122*a* may be circular, annular, square, or rectangular in shape. They may also have other geometric shapes not explicitly set out herein.

In order to prevent current from bypassing the heating elements and flowing directly between the second conductors and the current transfer layer, a dielectric layer is formed over the surface of the current transfer layer. Openings having substantially the same shape and size as the openings 98*a* or 122*a* are formed in the dielectric layer. When the heating element sections are formed on the dielectric layer, they extend through the openings in the dielectric layer and directly contact the current transfer layer. When the second conductors are subsequently formed, they do not contact the current transfer layer due to the presence of the dielectric layer surrounding the heating element sections. The dielectric layer formed over the current transfer layer may be formed from the same material used to form layer 96 in the FIG. 3 embodiment.

A heater chip 210, formed in accordance with a third embodiment of the present invention, is illustrated in FIGS. 9–14. The chip 210 comprises a main body portion 218 including a plurality of first and second conductors 260 and 270.

Figure 9:
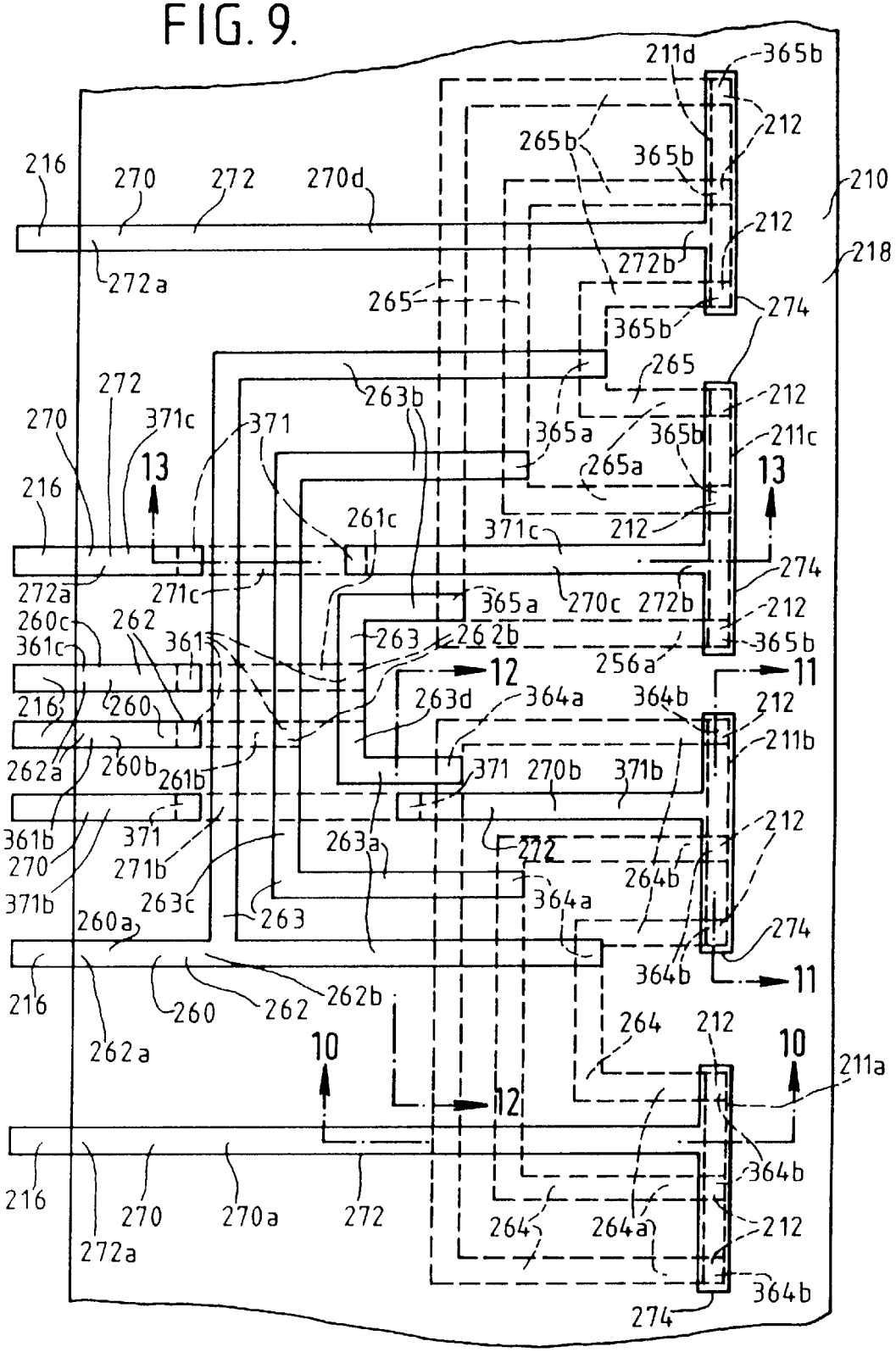
FIG. 9 is a plan view of first and second conductors and heating element sections of a heater chip formed in accordance with a third embodiment of the present invention wherein upper sections of the first and second conductors are shown in solid line and lower sections of the first and second conductors are shown in dotted line.
Figure 10:
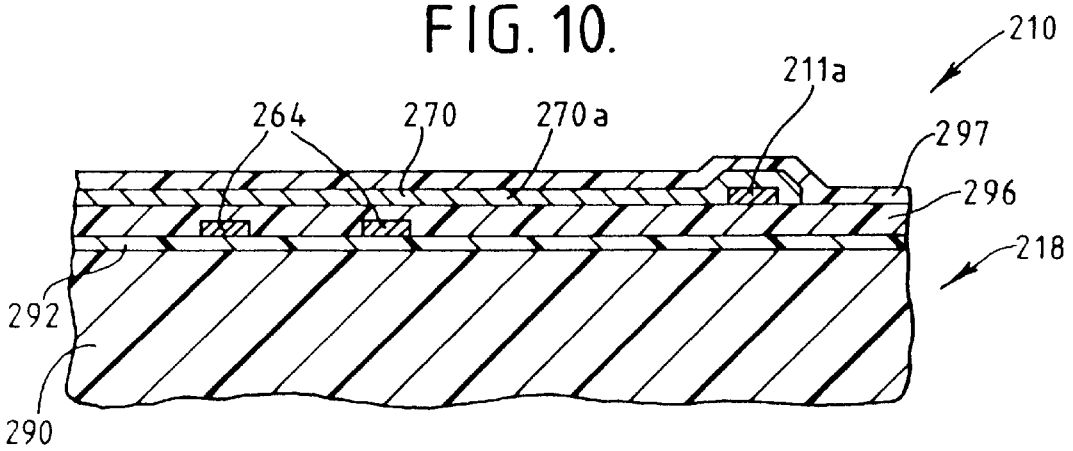
FIG. 10 is a view taken along view line 10—10 in FIG. 9.

Four generally rectangular heating element sections 211*a*–211*d* are provided on the chip 210 (shown in dotted line in FIG. 9). Portions of the heating element sections 211*a*–211*d* define subsections forming resistive heating elements 212. For ease in understanding, the heating elements 212 are designated by dotted line squares in FIG. 9.

The embodiment illustrated in FIG. 9 includes three first conductors 260*a*–260*c* and four second conductors 270*a*–270*d*. Each of the first conductors 260*a*–260*c* comprises a generally linear beginning portion 262, a generally U-shaped intermediate portion 263, a first generally U-shaped final portion 264 and a second generally U-shaped final portion 265. A first end 262*a* of the beginning portion 262 is coupled to a bond pad 216. A second, opposing end 262*b* of the beginning portion is 262 is integral with or in contact with a corresponding intermediate portion 263. The intermediate portion 263 has first and second legs 263*a* and 263*b*. The first leg 263*a* is in contact with a corresponding first final portion 264 and the second leg 263*b* is in contact with a corresponding second final portion 265. The first final portion 264 has first and second legs 264*a* and 264*b* and the second final portion 265 has third and fourth legs 265*a* and 265*b*. The first leg 264*a* extends below and is positioned in-line with the second conductor 270*a*, the second leg 264*b* extends below and is positioned in-line with the second conductor 270*b*, the third leg 265*a* extends below and is positioned in-ine with the second conductor 270*c*, and the fourth leg 265*b* extends below and is positioned in-line with the second conductor 270*d*. Thus, each of the four second conductors 270*a*–270*d* is positioned above and located in-line with a leg of each of the three first conductors 260*a*–260*c*.

Each of the second conductors 270 comprises a first segment 272 and a second segment 274 which is substantially transverse to the first segment 272. A first end 272*a* of the first segment 272 is coupled to a bond pad 216 while a second end 272*b* of the first segment 272 is coupled to a corresponding second segment 274 at an intermediate point along the second segment 274.

In order to effect the firing of a given heating element 212, current is passed through the first conductor 260 which is positioned directly below and engages the heating element 212 and the second conductor 270 which extends over and engages the heating element 212.

In this embodiment, the main body portion 218 further includes a base portion 290 and a first dielectric layer 292 formed over the base portion 290, see FIGS. 10–14. The base portion 290 may be formed from any one of the materials set out above from which the base portion 90 in the FIG. 3 embodiment is formed. The first layer 292 may be formed in essentially the same manner as the dielectric layer 92 in the FIG. 3 embodiment and from any one of the materials set out above from which the layer 92 is formed.

The first and second final portions 264 and 265 of the first conductors 260*a*–260*c*, lower sections 261*b* and 261*c* of the first conductors 260*b* and 260*c*, and lower sections 271*b* and 271*c* of the second conductors 270*b* and 270*c*, all shown in dotted line in FIG. 9, are formed on the dielectric layer 292. The final portions 264 and 265 and the lower sections 261*b*, 261*c*, 271*b* and 271*c* may be formed in essentially the same manner as the primary conductors 62 in the FIG. 3 embodiment and from any one of the materials set out above from which the conductors 62 are formed.

A second dielectric layer 296 is formed over the exposed parts of the dielectric layer 292, the final portions 264 and 265 and the lower sections 261*b*, 261*c*, 271*b* and 271*c*. The dielectric layer 296 may be formed in essentially the same manner as the layer 96 in the FIG. 3 embodiment and from the same material from which the layer 96 is formed.

The dielectric layer 296 extends into areas between the final portions 264 and 265 and the lower sections 261*b*, 261*c*, 271*b* and 271*c* so as to prevent current movement between those portions and sections. The layer 296 also covers the final portions 264 and 265 and the lower sections 261*b*, 261*c*, 271*b* and 271*c* except at points 364*a*, 364*b* and 365*a*, 365*b* on the final portions 264 and 265 and points 361 and 371 on the lower sections 261*b*, 261*c*, 271*b* and 271*c*. A conventional material removal process, a development process in the illustrated embodiment, is used to remove portions of the dielectric layer 296 located above the points 361, 364*a*, 364*b*, 365*a*, 365*b* and 371 so as to form openings 296*a* in the layer 96, see FIGS. 11–13.

Figure 11:
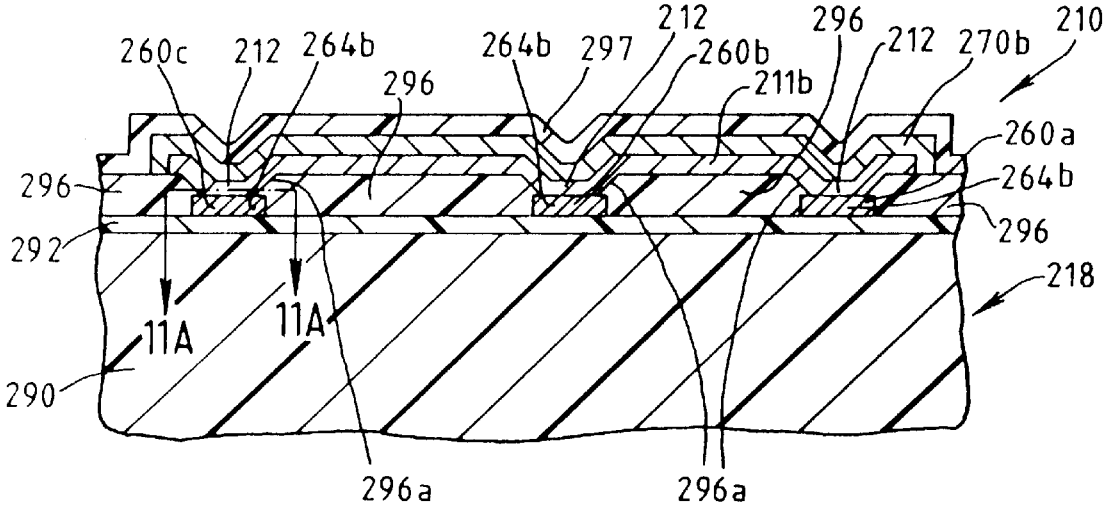
FIG. 11 is a view taken along view line 11—11 in FIG. 9.
Figure 11A:
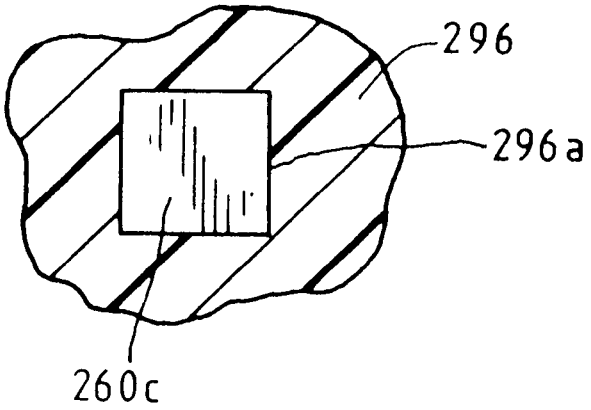
FIGS. 11A–11C are views of modified openings in the second dielectric layer of the heater chip shown in FIG. 11.
Figure 11B:
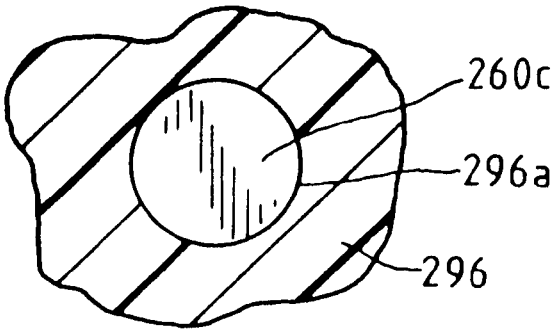
Figure 11C:
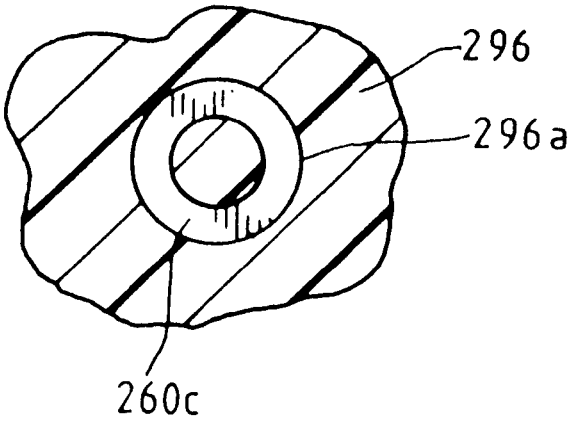
Figure 12:
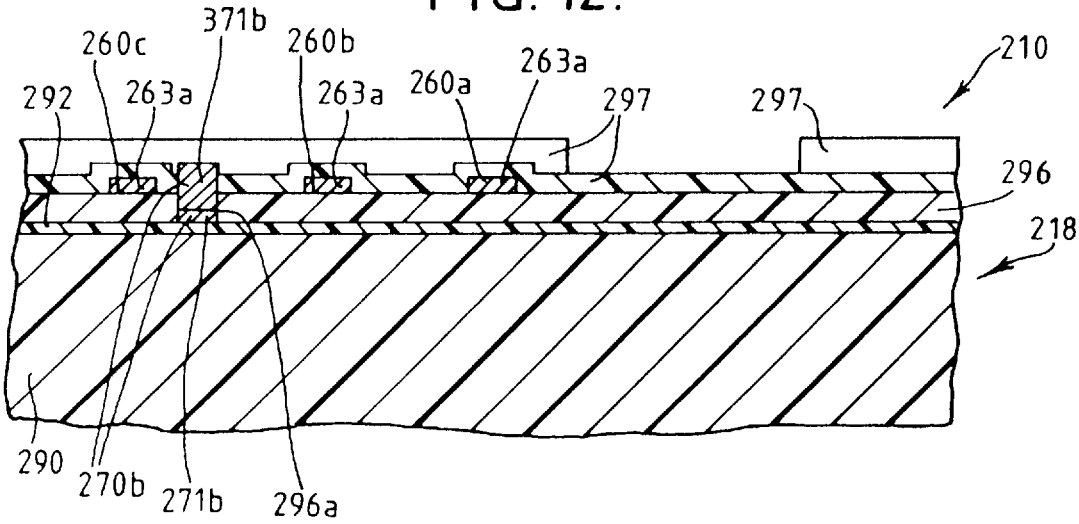
FIG. 12 is a view taken along view line 12—12 in FIG. 9.
Figure 13:
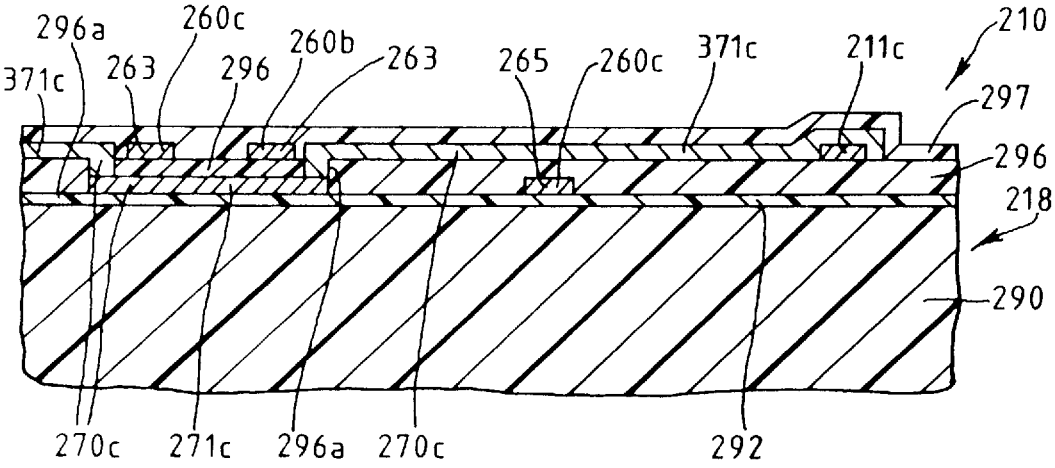
FIG. 13 is a view taken along view line 13—13 in FIG. 9.

The heating element sections 211*a*–211*d* are formed on the second dielectric layer 296. Portions of the sections 211*a*–211*d* extend through the openings 296*a* in the second dielectric layer 296 positioned above the points 364*b* and 365*b* on the final portions 264 and 265 such that the heating element sections 211*a*–211*d* directly contact the final portions 264 and 265 of the first conductors 260*a*–260*c*, see FIG. 11. The lower section of each opening 296*a* above the points 364*b* and 365*b* may be square as shown in FIG. 11A. Alternatively, it may be circular, as shown in FIG. 11B, annular, as shown in FIG. 11C, or may have any other geometric shape. The heating element sections 211*a*–211*d* may be formed in essentially the same manner as the heating elements sections 11*a*–11*d* in the FIG. 3 embodiment and from any one of the materials set out above from which the heating element sections 11*a*–11*d* are formed. The heating element sections 211*a*–211*d* may be rectangular, as shown in FIG. 9. Alternatively, the sections 211*a*–211*d* may be T-shaped or have another shape not explicitly set out herein. Further, smaller heating element sections may be provided, each of which defines only a single heating element.

The heating elements 212 comprise the heated zones of the heating element sections 211*a*–211*d* when current passes through the sections 211*a*–211*d*. The shape and size of the heated zones is defined generally by the size of the openings 296*a*.

Figure 14:
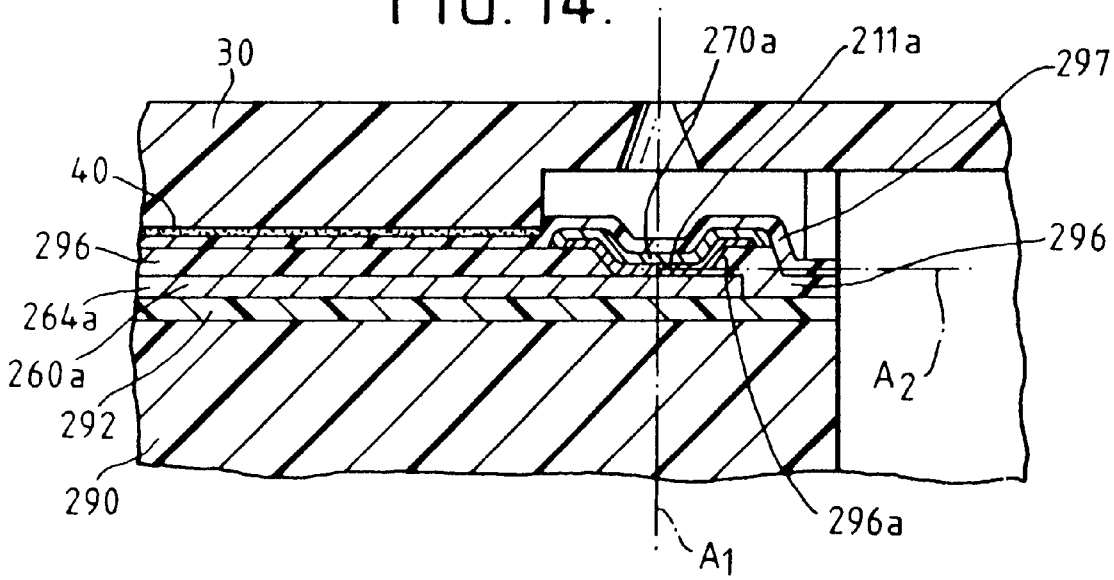
FIG. 14 is a cross-sectional view taken through a portion of a printhead having a heater chip constructed in accordance with the third embodiment of the present invention.

The heating elements 212, i.e., the resistive material layer portions extending into the openings 296*a* and between intersecting sections of the final portions 264 and 265 of the first conductors 260*a*–260*c* and the second segments 274 of the second conductors 270*a*–270*d* preferably have a substantially constant cross-sectional area along a first axis $A_1$ which is generally parallel to the direction of current flow between the portions 264 and 265 and the second segments 274, see FIG. 14. Because the cross-sectional area of each heating element 212 in the direction of current flow does not vary, it is believed that generally uniform heating of each heating element 212 will occur.

Since current flow in the present invention occurs along a generally vertical axis which passes through the heating element upper surface, i.e., the surface closest to the ink-containing chamber, each heating element 212 may have a substantially nonuniform cross-sectional area along a second axis $A_2$ which is generally orthogonal to the first axis $A_1$. Thus, the heated zones, i.e., the heating elements 212, of the heating element sections 211*a*–211*d* may be cylindrical in shape such that they have a circular ink-facing surface. The heated zones may also comprise hollow cylinders such that they have an annular ink-facing surface. The shape of the heated zones is determined by the shape of the openings 296*a*. If the openings 296*a* are circular, the heated zones will be cylindrical in shape. If the openings 296*a* are annular, the heated zones will have the shape of a hollow cylinder. Thus, the ink-facing surface of the heated zones or heating elements 212 may have a rounded or curvilinear section, e.g., they may be circular or annular in shape. They may also be square or rectangular in shape and have rounded corners. Consequently, each heating element 212 may be more readily configured so as to minimize damage to the heating element 212 due to concentrated shock waves produced during contraction of air bubbles in the ink. This added benefit may occur without sacrificing heating element efficiency as the cross-sectional area of each heating element 212 remains substantially constant in the direction of current flow.

Substantially the entire portion of each of the two second conductors 270*a* and 270*d*, the beginning portion 262 of the first conductor 260*a*, upper sections 361*b* and 361*c* of the first conductors 260*b* and 260*c*, upper sections 371*b* and 371*c* of the second conductors 270*b* and 270*c*, and the intermediate portions 263 are formed on the dielectric layer 296. The second segments 274 of the second conductors 270*a*–270*d* extend over the heating element sections 211*a*–211*d*, see FIGS. 9–11, 13 and 14. The portions 262 and 263 and the sections 361*b* and 361*c* may be formed in essentially the same manner as the primary conductors 68 of the FIG. 3 embodiment and from any one of the materials set out above from which the primary conductors 68 are formed. The conductors 270*a* and 270*d* and the sections 371*b* and 371*c* may be formed in essentially the same manner as the second conductors 70*a*–70*d* of the FIG. 3 embodiment and from any one of the materials set out above from which the conductors 70*a*–70*d* are formed.

The upper section 361*b* of the first conductor 260*b* extends through the opening 296*a* in the dielectric layer 296 above one of the points 361 on the lower section 261*b* so as to contact the lower section 261*b*. The upper section 361*c* of the first conductor 260*c* extends through the opening 296*a* in the dielectric layer 296 above one of the points 361 on the lower section 261*c* so as to contact the lower section 261*c*. The two upper sections 371*b* of the second conductor 270*b* extend through the openings 296*a* in the dielectric layer 296 above the points 371 on the lower section 271*b* so as to contact the lower section 271*b*. The two upper sections 371*c* of the second conductor 270*c* extend through the openings 296*a* in the dielectric layer 296 above the points 371 on the lower section 271*c* so as to contact the lower section 271*c*. The first and second legs 263*a* and 263*b* of each intermediate portion 263 extend through openings 296*a* in the dielectric layer 296 over points 364*a* and 365*a* on corresponding final portions 264 and 265 so as to engage those final portions 264 and 265. A central section 263*c* of the intermediate portion 263 forming part of the first conductor 260*b* extends through an opening 296*a* in the dielectric layer 296 so as to engage the lower section 261*b*. A central section 263*d* of the intermediate portion 263 forming part of the first conductor 260*c* extends through an opening 296*a* in the dielectric layer 296 so as to engage the lower section 261*c*.

A protective layer 297 is added over the exposed portions of the dielectric layer 296 and the first and second conductors 260*a*–260*c* and 270*a*–270*d*. Preferably, this layer 297 is formed from, for example, $Si_3N_4$ or SiC via art recognized deposition processes. The layer 297 may have a thickness of from about 500 angstroms to about 10,000 angstroms.

After the protective layer 297 has been formed, the orifice plate 30 is secured to the layer 297 via an adhesive 40.

Figure 14A:
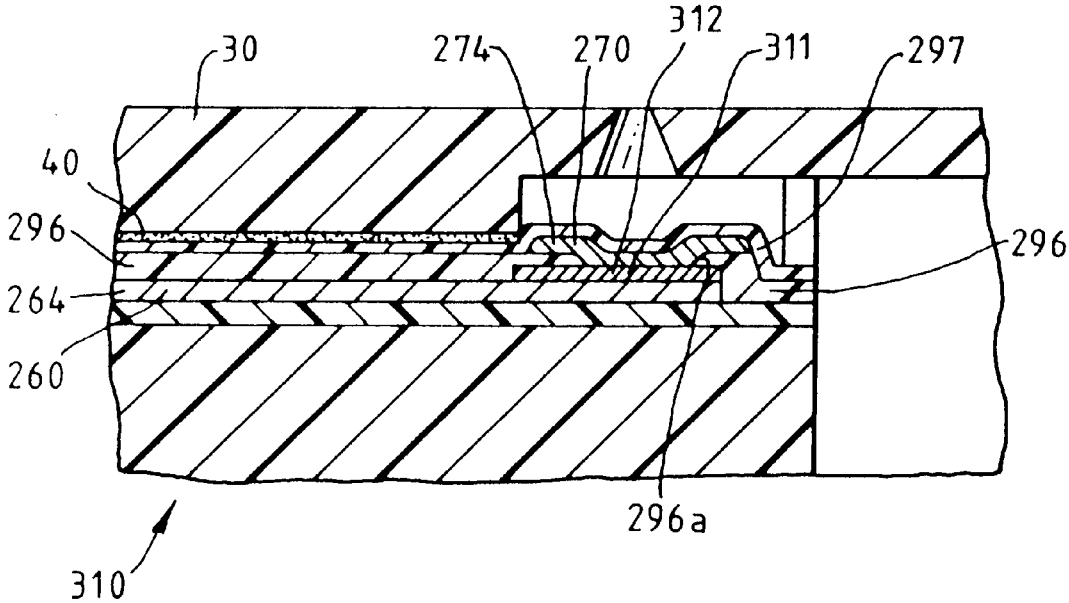
FIG. 14A is a cross-sectional view taken through a portion of a printhead having a heater chip constructed in accordance with a fourth embodiment of the present invention.

A heater chip 310 formed in accordance with a fourth embodiment of the present invention is illustrated in FIG. 14A, wherein like reference numerals indicate like elements. In this embodiment, the heating element section 311 is formed directly over the final portion 264 of the first conductor 260. The second dielectric layer 296 extends over parts of the heating element section 311. The second segment 274 of the second conductor 270 is formed over the dielectric layer 296 and extends through three openings 296*a* in the layer 296 so as to contact the heating element section 311 at three spaced-apart portions along the heating element section 311. Each spaced-apart portion of the heating element section 311 comprises a heating element 312.

Figure 15:
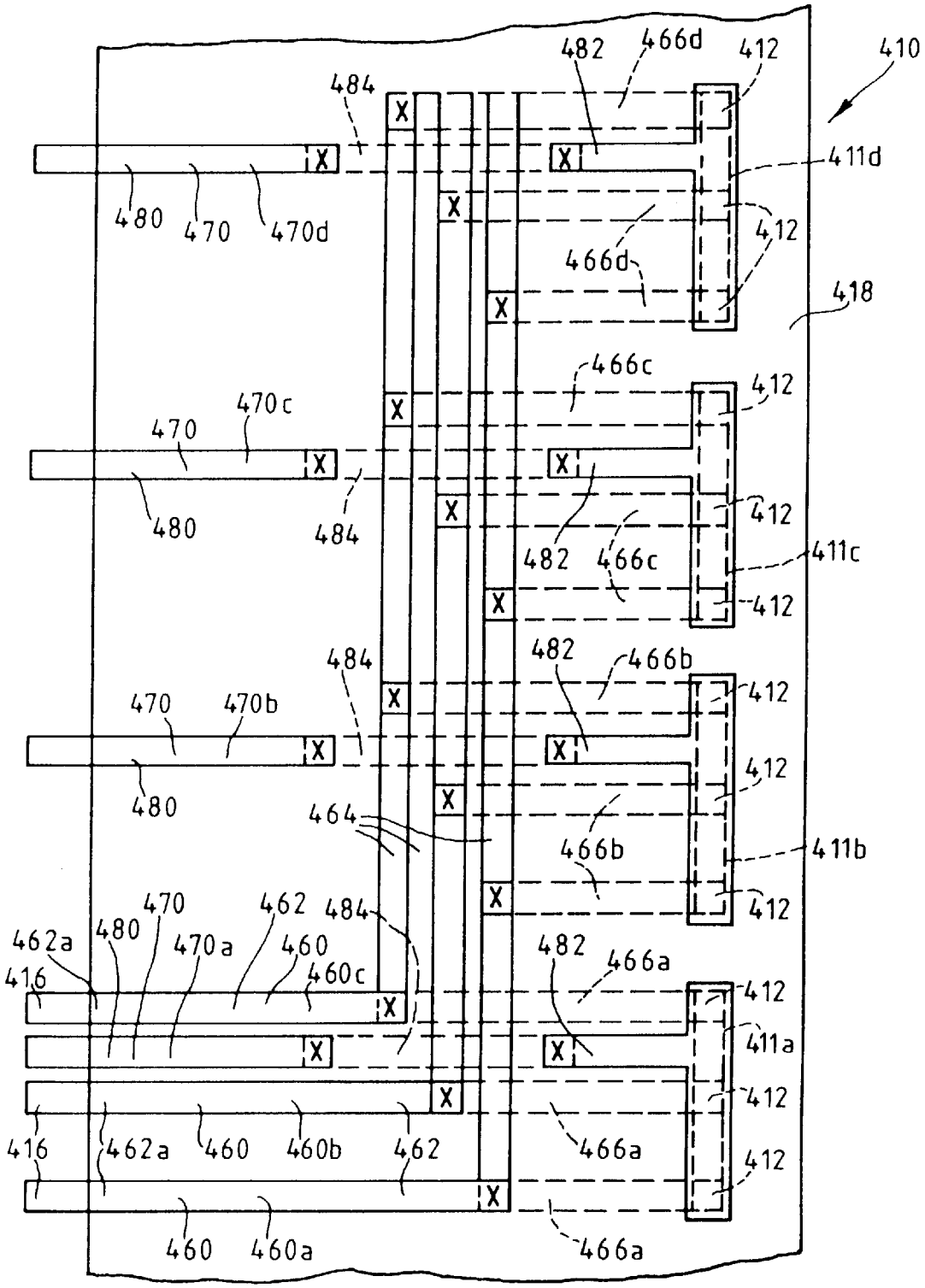
FIG. 15 is a plan view of first and second conductors of a heater chip constructed in accordance with a fifth embodiment of the present invention.
Figure 16:
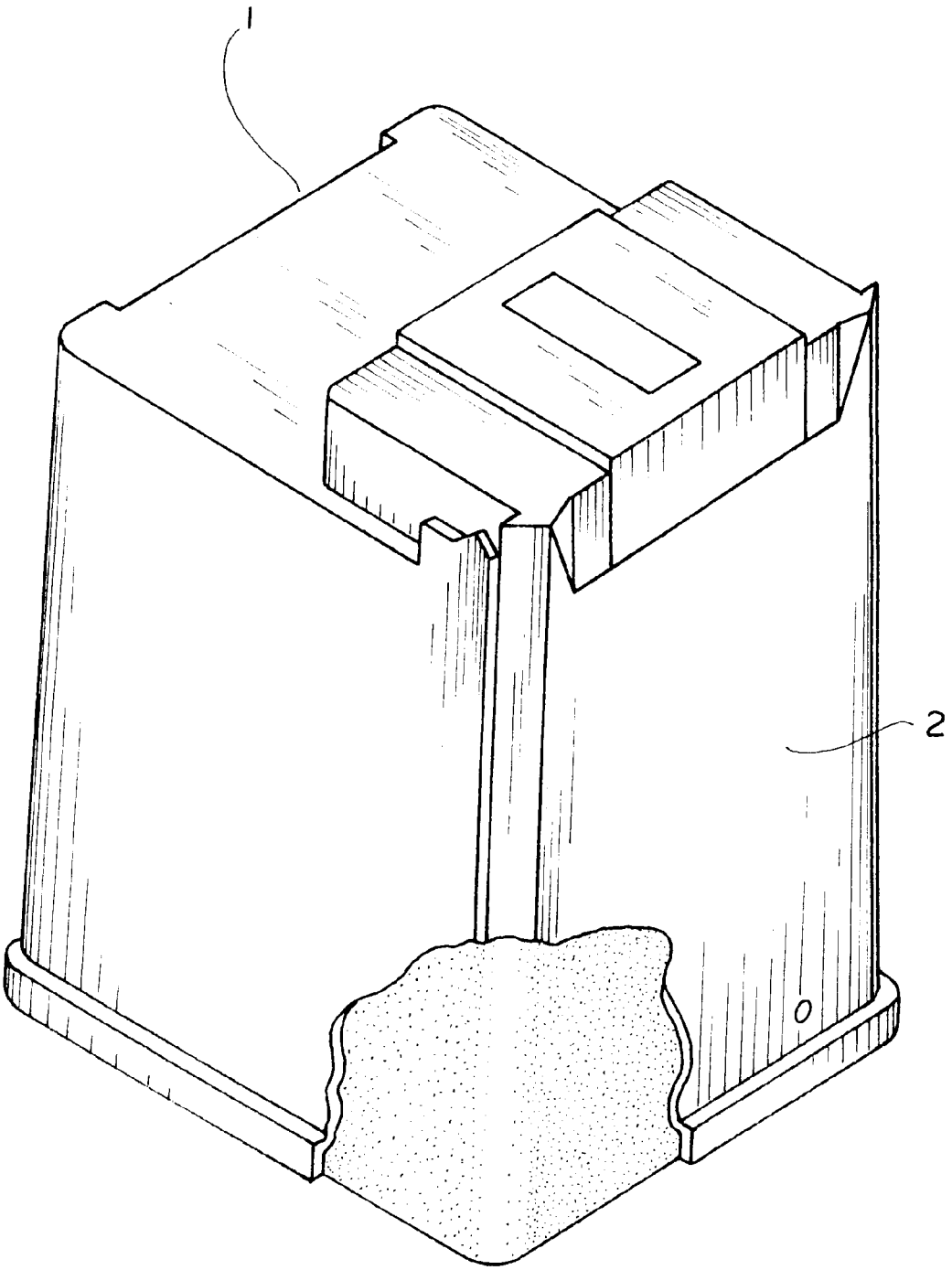
FIG. 16 is a perspective view of an ink jet cartridge comprising the heater chip of the present invention.

A heater chip 410, formed in accordance with a fifth embodiment of the present invention, is illustrated in FIG. 15. The chip 410 comprises a main body portion 418 including a plurality of first and second conductors 460 and 470. The main body portion 418 is constructed in essentially the same manner as the main body portion 218 in the embodiment illustrated in FIG. 9.

Four generally rectangular heating element sections 411*a*–411*d* are provided on the chip 410 (shown in dotted line in FIG. 9). Portions of the heating element sections 411*a*–411*d* define resistive heating elements 412. For ease in understanding, the heating elements 412 are designated by dotted line squares in FIG. 15.

The embodiment illustrated in FIG. 15 includes three first conductors 460*a*–460*c* and four second conductors 470*a*–470*d*. Each of the first conductors 460*a*–460*c* comprises first and second upper portions 462 and 464 and four lower third portions 466*a*–466*d*. A first end 462*a* of the first portion 462 is coupled to a bond pad 416. The second portion 464 extends generally at a right angle to the first portion 462 and is integral with the first portion 462. Each of the four third portions 466*a*–466*d* to which a second portion 464 is connected extends below and is positioned in-line with a different one of the four second conductors 470*a*–470*d*. Thus, each of the four second conductors 470*a*–470*d* is positioned above and is located in-line with a single third portion of each of the first conductors 460*a*–460*c*.

A second dielectric layer, formed in the same manner and from the same material as the dielectric layer 296 in the FIG. 9 embodiment, is positioned between the first and second portions 462 and 464 and the third portions 466*a*–466*d*. The heating element sections 411*a*–411*d* are formed on the second dielectric layer. Openings (not shown), similar to the openings 296*a* in dielectric layer 296, are formed in the second dielectric layer. Each second portion 464 extends through four openings in the second dielectric layer so as to contact its corresponding four third portions 466*a*–466*d*. Likewise, the heating element sections 411*a*–411*d* extend through openings in the second dielectric layer so as to contact the third portions 466*a*–466*d*. The heating element sections 411*a*–411*d* are rectangular in the illustrated embodiment but may be of any shape. However, the sections 411*a*–411*d* should not extend along the upper surface of the second dielectric layer so as to be positioned at locations where the second portions 464 extend through openings in the second dielectric layer to contact the third portions 466*a*–466*d*.

Each of the second conductors 470*a*–470*d* comprises first and second upper portions 480 and 482 and a third lower portion 484. The second dielectric layer extends over parts of the lower portions 484. The first and second portions 480 and 482 are formed on the second dielectric layer and extend through openings in the second dielectric layer so as to contact opposite ends of the lower portions 484. The second portions 482 also contact the heating element sections 411*a*–411*d*.

It is further contemplated that the upper portions 462, 464, 480 and 482 of the first and second conductors 460*a*–460*c* and 470*a*–470*d* may be formed on the first dielectric layer (not shown) of the main body portion 418 such that they are positioned below the second dielectric layer and the lower portions 466*a*–466*d* and 484 may be formed on the upper surface of the second dielectric layer.

It is further contemplated that the upper and lower portions and sections of the first and second conductors 260*a*–260*c* and 270*a*–270*d* in the FIG. 9 embodiment may be reversed such that the upper portions and sections are positioned below the second dielectric layer 296 and the lower portions and sections are positioned on the dielectric layer 296.

What is claimed is:

1. A heater chip comprising:

a main body portion;

at least one beating element provided on said main body portion, said main body portion including at least one first conductor and at least one second conductor for providing energy to said at least one heating element, said at least one first conductor being positioned in a first plane and said at least one second conductor being positioned in a second plane which is vertically spaced from said first plane, a current transfer layer having low thermal conductivity interposed between said at least one first conductor and said at least one heating element, said current transfer layer conducting current, between said at least one first conductor and said at least one heating element and a dielectric layer interposed between said at last one first conductor and said current transfer layer, said dielectric layer having holes therein for transferring current from said at least one first conductor to said current transfer layer.

2. A heater chip as set forth in claim 1, wherein said first conductor comprises a primary conductor and a secondary conductor.

3. A heater chip as set forth in claim 2, wherein said main body portion further comprises:

a base portion; and wherein said dielectric layer further comprises first, second and third dielectric layers, said first dielectric layer positioned over said base portion, said primary conductor being formed on said first dielectric layer;

said second dielectric layer provided over portions of said first dielectric layer and portions of said primary conductor, said secondary conductor being formed on said second dielectric layer;

said third dielectric layer provided over portions of said second dielectric layer and portions of said secondary conductor; and said current transfer layer extending over portions of said third dielectric layer and end regions of said secondary conductor, said at least one heating element being positioned on said current transfer layer and said at least one second conductor extending to said at least one heating element such that current flows to said at least one heating element through said at least one first and said at least one second conductors.

4. A heater chip as set forth in claim 2, wherein said dielectric layer further comprises:

a first dielectric layer having said secondary conductor formed on a first side thereof and including an opening through which said secondary conductor extends;

a second dielectric layer extending over portions of said first dielectric layer and portions of said secondary conductor, said primary conductor being formed on said second dielectric layer; and said current transfer layer located on a second side of said first dielectric layer and engaging said secondary conductor, said at least one heating element being positioned on said current transfer layer and said at least one second conductor contacting said at least one heating element such that current flows to said at least one heating element through said at least one first and said at least one second conductors.

5. A heater chip as set forth in claim 4, wherein said first dielectric layer and said current transfer layer comprise an integral film substrate.

6. A heater chip as set forth in claim 1, said at least one first conductor further comprising a primary conductor and a secondary conductor, wherein said primary conductor has a first end which is coupled to a bond pad and a second end which is coupled to a first end of said secondary conductor, said secondary conductor having an end which is vertically aligned with said at least one heating element.

7. A heater chip as set forth in claim 1, wherein said at least one heating element comprises a plurality of heating subsections. said at least one first conductor comprises a plurality of conductors positioned in said first plane and said at least one second conductor comprises a plurality of conductors positioned in said second plane.

8. A heater chip as set forth in claim 7, wherein said plurality of first and second conductors are arranged in a matrix having a plurality of first conductor rows and a plurality of second conductor columns.

9. A heater chip as set forth in claim 7, further comprising a heating element section formed on said main body portion, wherein a portion of said heating element section defines each of said plurality of heating elements.

10. A heater chip as set forth in claim 1, wherein said current transfer layer is a high temperature resistant polymer containing an electrically conductive filler.

11. A heater chip as set forth in claim 1, wherein said current transfer layer is a carbon filled polyimide material.

12. A heater chip as set forth in claim 1, wherein said at least one heating element is composed of tantalum oxide.

13. A heater chip as set forth in claim 1, wherein said dielectric layer is a photoresist layer.

14. An inkjet printhead comprising:

a plate having at least one orifice through which ink droplets are ejected; and a heater chip coupled to said plate and including a main body portion provided with at least one heating element, said main body portion including at least one first conductor and at least one second conductor for providing energy to said at least one heating element, said at least one first conductor being positioned in a first plane and said at least one second conductor being positioned in a second plane, said at least one first conductor being vertically spaced from said at least one second conductor, a current transfer layer having low thermal conductivity interposed between said at least one first conductor and said at least one heating element, said current transfer layer conducting current between said at least one first conductor and said at least one heating element and a dielectric layer interposed between said at least one first conductor and said current transfer layer, said dielectric layer having holes therein for transferring current between said at least one first conductor to said current transfer layer.

15. An ink jet printhead as set forth in claim 14, wherein said at least one heating element comprises a plurality of heating subsections.

16. An ink jet printhead as set forth in claim 15, wherein sections of said plate and portions of said heater chip define a plurality of ink-containing chambers, and said plurality of heating elements are positioned on said heater chip such that each of said ink-containing chambers has one of said heating elements associated therewith.

17. An ink jet printhead as set forth in claim 14 wherein said heater chip comprises a heating element section formed on said main body portion, said at least one heating element being defined by a portion of said heating element section.

18. An ink jet printhead as set forth in claim 14, wherein said first conductor comprises a primary conductor and a secondary conductor.

19. An ink jet printhead as set forth in claim 18, wherein said main body portion further comprises:

a base portion; and wherein said dielectric layer further comprises first, second and third dielectric layers, said first dielectric layer positioned over said base portion, said primary conductor being formed on said first dielectric layer;

said second dielectric layer provided over portions of said first dielectric layer and portions of said primary conductor, said secondary conductor being formed on said second dielectric layer, said third dielectric layer provided over portions of said second dielectric layer and portions of said secondary conductor; and said current transfer layer extending over portions of said third dielectric layer and end regions of said secondary conductor, said at least one heating element being positioned on said current transfer layer and said at least one second conductor extending to said at least one heating element such that current flows to said at least one heating element through said at least one first and said at least one second conductors.

20. An ink jet printhead as set forth in claim 18, wherein said dielectric layer further comprises a first dielectric layer having said secondary conductor formed on a first side thereof and including an opening through which said secondary conductor extends;

a second dielectric layer extending over portions of said first dielectric layer and portions of said secondary conductor, said primary conductor being formed on said second dielectric layer; and said current transfer layer located on a second side of said first dielectric layer and engaging said secondary conductor, said at least one heating element being positioned on said current transfer layer and said at least one second conductor contacting said at least one heating element such that current flows to said at least one heating element trough said at leas tone first and said at least one second conductors.

21. An ink jet printhead as set forth in claim 18, wherein said primary conductor has a first end coupled to a bond pad and a second end which is coupled to a first end of said secondary conductor, said secondary conductor further including a second end which is positioned near said heating element.

22. An ink jet printhead as set forth in claim 14, wherein said at least one heating element comprises a plurality of heating subsections, said at least one first conductor comprises a plurality of conductors positioned in said first plane and said at least one second conductor comprises a plurality of conductors positioned in said second plane.

23. An ink jet printhead as set forth in claim 22, wherein said plurality of first and second conductors are arranged in a matrix.

24. An ink jet printhead as set forth in claim 14, wherein said printhead forms part of an ink jet print cartridge.

25. An ink jet printhead as set forth in claim 24, wherein said print cartridge further comprises a container filled with ink.

26. An ink jet printhead as set forth in claim 25, wherein said container may be refilled with ink.

27. An ink jet printhead as set forth in claim 14, wherein said current transfer layer is a high temperature resistant polymer containing an electrically conductive filler.

28. An ink jet printhead as set forth in claim 14, wherein said current transfer layer is a carbon filled polyimide material.

29. An ink jet printhead as set forth in claim 14, wherein said at least one heating element is composed of tantalum oxide.

30. A chip comprising:

a main body portion;

at least one resistor provided on said main body portion; and, said main body portion including at least one first conductor and at least one second conductor for providing energy to said at least one resistor, said at least one first conductor being in a first plane vertically spaced from said at least one second conductor in a second plane, a current transfer layer located between said at least one first conductor and said at least one resistor, said current transfer layer being substantially thermally non-conductive, and a dielectric layer interposed between said at least one first conductor and said current transfer layer, said dielectric layer having holes therein for transferring current between said at least one first conductor to said current transfer layer.

31. A chip as set forth in claim 30, wherein said current transfer layer has a thermal conductivity of from about 0.1 W/m° C. to about 15 W/m° C.

32. A chip as set forth in claim 30, wherein said first conductor comprises a primary conductor and a secondary conductor.

33. A chip as set forth in claim 32, wherein said main body portion further comprises:

a base portion;

and wherein said dielectric layer further comprises a first dielectric layer positioned over said base portion, said primary conductor being formed on said first dielectric layer;

a second dielectric layer provided over portions of said first dielectric layer and portions of said primary conductor, said secondary conductor being formed on said dielectric layer;

a third dielectric layer provided over portions of said second dielectric layer and portions of said secondary conductor; and said current transfer layer extends over portions of said third dielectric layer and end regions of said secondary conductor, said at least one resistor being positioned on said current transfer layer and said at least one second conductor extending to said at least one resistor such that current flows to said at least one resistor through said at least one first and said at least one second conductors.

34. A chip as set forth in claim 32, wherein said dielectric layer further comprises:

a first dielectric layer having said secondary conductor formed on a first side thereof and including an opening through which said secondary conductor extends;

a second dielectric layer extending over portions of said first dielectric layer and portions of said secondary conductor, said primary conductor being formed on said second dielectric layer; and said current transfer layer is located on a second side of said first dielectric layer and engaging said secondary conductor, said at least one resistor being positioned on said current transfer layer and said at least one second conductor contacting said at least one resistor such that current flows to said at least one resistor through said at least one first and said at least one second conductors.

35. A chip as set forth in claim 34, wherein said first dielectric layer and said current transfer layer comprise an integral film substrate.

36. A chip as set forth in claim 30, wherein said at least one resistor comprises a plurality of resistive subsections, said at least one first conductor comprises a plurality of conductors and said at least one second conductor comprises a plurality of conductors.

37. A chip as set forth in claim 36, wherein said plurality of first and second conductors are arranged in a matrix.

38. A chip as set forth in claim 27, wherein said current transfer layer is a high temperature resistant polymer containing an electrically conductive filler.

39. A chip as set forth in claim 30, wherein said current transfer layer is a carbon filled polyimide material.

40. A chip as set forth in claim 30, wherein said dielectric layer is a photoresist layer.

41. A chip as set forth in claim 30, wherein said at least one resistor is composed of tantalum oxide.

42. A heater chip comprising:

a main body portion; and a plurality of heating elements provided on said main body portion, said main body portion including a plurality of first and second conductors arranged in a matrix, said conductors providing energy to said plurality of heating elements, a current transfer layer having low thermal conductivity interposed between said first conductors and said heating elements and a dielectric layer interposed between said first conductors and said heating elements, said dielectric layer having holes therein for transferring current from said first conductors to said current transfer layer.

43. A heater chip as set forth in claim 42, further comprising a heating element section formed on said main body portion, wherein a portion of said heating element section defines each of said plurality of heating elements.

44. A heater chip as set forth in claim 42, wherein said current transfer layer is a high temperature resistant polymer contain an electrically conductive filler.

45. A heater chip as set forth in claim 42, wherein said current transfer layer is a carbon filled polyimide material.

46. A heater chip as set forth in claim 42, wherein said dielectric layer is a photoresist layer.

47. A heater chip as set forth in claim 42, wherein said heating elements are composed of tantalum oxide.

48. A chip comprising:

a first conductor positioned in a first plane;

a second conductor positioned in a second plane vertically spaced apart from said first conductor on said first plane;

a current transfer layer having low thermal conductivity interposed between said first conductor and said second conductor for conducting current;

a dielectric layer interposed between said first conductor and said current transfer layer, said dielectric layer having holes therein for transferring current between said first conductor to said current transfer layer; and a resistor contacting said current transfer layer and said second conductor.

49. A chip as set forth in claim 48, wherein said first conductor further comprises a primary conductor and a secondary conductor.

50. A chip as set forth in claim 49, wherein said dielectric layer further comprises a plurality of dielectric layers positioned between a base and said primary conductor of said first conductor, between said primary conductor and said secondary conductor; and between said secondary conductor and said current transfer layer.

51. A chip as set forth in claim 48, wherein said current transfer layer is a high temperature resistant polymer loaded with an electrically conductive filler.

52. A chip as set forth in claim 48, wherein said current transfer layer is a carbon filled polyimide material.

53. A chip as set forth in claim 48, wherein said resistor is composed of tantalum oxide.

54. A chip as set forth in claim 48, wherein said dielectric layer is a photoresist layer.

55. A chip as set forth in claim 48, wherein said current transfer layer and said dielectric layer integrally form a substrate upon which said chip is constructed.

* * * * *

UNITED STATES PATENT AND TRADEMARK OFFICE
CERTIFICATE OF CORRECTION

PATENT NO : 6,030,071

DATED : February 29, 2000

INVENTOR(S) : Steven Robert Komplin, et al.

It is certified that error appears in the above-identified patent and that said Letters Patent is hereby corrected as shown below:

Col. 17, line 62
replace "elements"
with --subsections--.

Signed and Sealed this

Thirteenth Day of February, 2001

*Attest:*

NICHOLAS P. GODICI

*Attesting Officer*

*Acting Director of the United States Patent and Trademark Office*